US009605842B1

(12) United States Patent
Davis

(10) Patent No.: US 9,605,842 B1
(45) **Date of Patent: *Mar. 28, 2017**

(54) LED MODULE WITH MOUNTING PADS

(71) Applicant: Cooper Technologies Company, Houston, TX (US)

(72) Inventor: Jared Michael Davis, Newnan, GA (US)

(73) Assignee: COOPER LIGHTING, LLC, Peachtree City, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/690,188

(22) Filed: Apr. 17, 2015

Related U.S. Application Data

(63) Continuation of application No. 13/048,435, filed on Mar. 15, 2011, now Pat. No. 9,010,956.

(51) Int. Cl.

| | |
|---|---|
| ***F21V 15/00*** | (2015.01) |
| ***F21V 29/70*** | (2015.01) |
| ***F21V 7/00*** | (2006.01) |
| ***F21V 21/14*** | (2006.01) |
| ***F21S 8/02*** | (2006.01) |
| *F21Y 101/02* | (2006.01) |

(52) U.S. Cl.
CPC ..... *F21V 29/70* (2015.01); *F21S 8/026* (2013.01); *F21V 7/0066* (2013.01); *F21V 21/14* (2013.01); *F21Y 2101/02* (2013.01)

(58) Field of Classification Search
CPC ..... F21V 17/06; F21V 21/042; F21V 21/044; F21V 21/046; F21V 19/0035; F21V 21/04; F21S 8/026
See application file for complete search history.

(56) References Cited

U.S. PATENT DOCUMENTS

| | | | |
|---|---|---|---|
| 4,313,154 | A | 1/1982 | Capostagno et al. |
| 4,399,497 | A | 8/1983 | Druffel |
| 4,754,377 | A | 6/1988 | Wenman |
| 5,957,574 | A | 9/1999 | Hentz et al. |
| 6,082,878 | A | 7/2000 | Doubek et al. |
| 6,286,265 | B1 | 9/2001 | Rinderer |
| 6,343,873 | B1 | 2/2002 | Eberhard et al. |
| 6,364,511 | B1 | 4/2002 | Cohen |

(Continued)

OTHER PUBLICATIONS http://www abbaba.com/showroom/recessed-mounted-downLight.html; Feb. 27, 2014.

(Continued)

*Primary Examiner* — Sean Gramling
(74) *Attorney, Agent, or Firm* — King & Spalding LLP

(57) ABSTRACT

A light module includes a heat sink and one or more light sources coupled within a heat sink cavity formed therein. The heat sink includes an internal surface surrounding the cavity. The internal surface includes a mounting region, a reflector region extending from the perimeter of the mounting region to a distal end, and a decorative region extending from the distal end to a second distal end. The light module includes multiple mounting pads coupled circumferentially around a portion of the heat sink. The mounting pads are configured to facilitate the heat sink being coupled within different housing diameter sizes. The light module includes a trim ring integrally formed with the heat sink and extending radially outward from one end of the heat sink.

14 Claims, 5 Drawing Sheets

(56) References Cited

U.S. PATENT DOCUMENTS

| | | | | |
|---|---|---|---|---|
| 6,431,723 | B1 | 8/2002 | Schubert et al. | |
| 6,517,218 | B2 | 2/2003 | Hochstein | |
| 6,554,457 | B1 | 4/2003 | Platt | |
| 6,787,999 | B2 | 9/2004 | Stimac et al. | |
| 7,102,172 | B2 | 9/2006 | Lynch et al. | |
| 7,213,940 | B1 | 5/2007 | Van de Ven et al. | |
| D545,988 | S * | 7/2007 | Goetz-Schaefer | D26/71 |
| 7,344,279 | B2 | 3/2008 | Mueller et al. | |
| 7,374,308 | B2 | 5/2008 | Sevack et al. | |
| 7,530,705 | B2 * | 5/2009 | Czech | F21S 8/02 248/288.11 |
| D595,005 | S | 6/2009 | Chou | |
| 7,597,460 | B1 | 10/2009 | Rashidi | |
| D610,289 | S | 2/2010 | Yoshinobu et al. | |
| 7,658,517 | B2 | 2/2010 | Czech et al. | |
| 7,722,227 | B2 | 5/2010 | Zhang et al. | |
| D624,691 | S | 9/2010 | Zhang et al. | |
| 7,862,214 | B2 | 1/2011 | Trott et al. | |
| D636,115 | S | 4/2011 | Dai | |
| D636,921 | S | 4/2011 | Van de Ven et al. | |
| D638,160 | S | 5/2011 | Van de Ven et al. | |
| 8,348,477 | B2 | 1/2013 | Tickner et al. | |
| 8,348,479 | B2 | 1/2013 | Tickner et al. | |
| 8,789,978 | B2 | 7/2014 | Tickner et al. | |
| 2005/0174780 | A1 | 8/2005 | Park | |
| 2007/0253202 | A1 | 11/2007 | Wu et al. | |
| 2008/0130298 | A1 | 6/2008 | Negley et al. | |
| 2008/0304269 | A1 | 12/2008 | Pickard et al. | |
| 2010/0039829 | A1 | 2/2010 | Tsai | |
| 2010/0061108 | A1 | 3/2010 | Zhang et al. | |
| 2010/0085766 | A1 | 4/2010 | Czech et al. | |
| 2010/0110699 | A1 | 5/2010 | Chou | |

OTHER PUBLICATIONS

The Future of Lighting Today, Seagull Lighting Brochure; Low profile Stylish Downlights with Breakthrough Features; Dec. 21, 2009.

* cited by examiner

LED MODULE WITH MOUNTING PADS

CROSS REFERENCE TO RELATED APPLICATIONS

This application is a continuation of and claims priority to U.S. Non-Provisional patent application Ser. No. 13/048,435 filed on Mar. 15, 2011, the entire contents of which are hereby incorporated herein by reference.

TECHNICAL FIELD

The present invention relates generally to luminaires. More specifically, the invention relates to a light emitting diode (LED) module that is used in a recessed luminaire.

BACKGROUND

LEDs offer benefits over incandescent and fluorescent lights as sources of illumination. Such benefits include high energy efficiency and longevity. To produce a given output of light, LEDs consume less electricity than incandescent or fluorescent lights. Additionally, on average, LEDs last longer than incandescent or fluorescent lights before failing.

The level of light a typical LED outputs depends upon the amount of electrical current supplied to the LED and upon the operating temperature of the LED. That is, the intensity of light emitted by the LED changes according to electrical current and LED temperature. Operating temperature also impacts the usable lifetime of LEDs.

As a byproduct of converting electricity into light, LEDs generate heat and raise the operating temperature, resulting in efficiency degradation and premature failure. Typically, a heat management system, such as a heat sink, is used in conjunction with the LEDs to facilitate maintenance of proper LED operating temperatures. Conventional LED-based recessed luminaires include a housing and a conventional LED module that is coupled within the housing. The conventional LED module includes a heat sink, a fastening device for facilitating coupling between the conventional LED module and the housing, and one or more LEDs. The housing includes a cavity formed therein and an opening at one end. The housing is installed within and above an aperture formed in a support structure, such as a ceiling, and oriented such that the opening faces a desired illumination area, such as a room. Typically, a space is formed around and between the lower exterior portion of the housing and the perimeter of the aperture. The opening is positioned in substantially the same plane as a lower surface of the support structure; however, the opening can be positioned in a different plane, such as slightly above the lower surface of the support structure.

The heat sink is installed and fitted within the cavity of the housing, generally using one or more fastening devices, such as torsion springs, and substantially occupies the entirety of the diameter of the cavity to maximize its heat removal performance. The conventional LED module is designed to fit within a housing having an opening with a certain nominal diameter. For example, one conventional LED module is designed to fit within a housing having a six inch nominal diameter opening, while a different conventional LED module is designed to fit within a different housing having a five inch nominal diameter opening. Thus, the conventional LED module typically is not designed to flexibly fit within housings having differently sized nominal diameter openings. The LEDs are typically coupled to a substrate, which is in thermal communication with the heat sink. The LEDs emit light and are oriented in a manner such that the light is directed to the desired illumination area through the opening.

Conventional LED-based recessed luminaires can also include a trim ring. The trim ring is positioned adjacent to the opening and covers the opening. The trim ring typically is separably coupled to the heat sink or to a portion of the housing, generally by use of torsion springs, and is positioned so that at least a portion of the trim ring extends below the support structure and covers the space formed between the lower exterior portion of the housing and the support structure when viewed from an area below the support structure. The trim ring is thermally coupled to the heat sink; however, since the trim ring is separably coupled to either the heat sink or the housing, the amount of heat removal from the trim ring into the area below the support structure, or room area, is limited because the area of direct contact between the trim ring and the heat sink is reduced. Some conventional LED-based recessed luminaires also include a reflector. The reflector typically is separably disposed within the heat sink and surrounds the LEDs. The reflector directs light emitted from the LEDs toward the opening. Conventional LED-based recessed luminaires having several separably coupled components increase costs related to tooling costs and assembly costs.

SUMMARY

A light module can include a heat sink and one or more light sources. The heat sink can include an internal surface surrounding a heat sink cavity formed therein. The internal surface can include a mounting region, a reflector region, and a decorative region. The reflector region can extend from the perimeter of the mounting region to a distal end. The decorative region can extend from the distal end to a second distal end. The light sources can be coupled to the mounting region within the heat sink cavity.

Another exemplary embodiment includes a light module that can include a heat sink, one or more light sources, and at least one mounting pad. The heat sink can include an internal surface surrounding a heat sink cavity formed therein. The light sources can be coupled to a portion of the internal surface of the heat sink cavity. The mounting pad can be coupled circumferentially around a portion of the heat sink. Each mounting pad can include a coupling hole, a first locator, and a second locator. The second locator can be positioned closest to an interior portion of the heat sink. The first locator can be positioned between the second locator and the coupling hole.

Another exemplary embodiment includes a light module. The light module can include a heat sink, one or more LED packages, and at least one mounting pad. The heat sink can include an internal surface surrounding a heat sink cavity formed therein. The internal surface can include a mounting region, a reflector region, and a decorative region. The reflector region can extend from the perimeter of the mounting region to a distal end. The decorative region can extend from the distal end to a second distal end. The LED package can be coupled to a portion of the internal surface of the heat sink cavity. The mounting pad can be disposed circumferentially around a portion of the heat sink. Each mounting pad can include a coupling hole, a first locator, and a second locator. The coupling hole, the first locator, and the second locator are radially and linearly aligned with one another. The second locator can be positioned closest to an interior portion of the heat sink. The first locator can be positioned between the second locator and the coupling hole.

BRIEF DESCRIPTION OF THE DRAWINGS

For a more complete understanding of the present invention and the advantages thereof, reference is now made to the following description, in conjunction with the accompanying figures briefly described as follows.

The drawings illustrate only exemplary embodiments of the invention and are therefore not to be considered limiting of its scope, as the invention may admit to other equally effective embodiments.

DETAILED DESCRIPTION OF THE EXEMPLARY EMBODIMENTS

Exemplary embodiments of the present invention are directed to luminaires. The term "luminaire," as used herein, generally refers to a system for producing, controlling, and/or distributing light for illumination. For example, a luminaire includes a system that outputs or distributes light into an environment, thereby allowing certain items in that environment to be more visible. Such a system could be a complete lighting unit that includes one or more LEDs, or LED packages, for converting electrical energy into light, sockets, connectors, or receptacles for mechanically mounting and/or electrically connecting components to the system, optical elements for distributing light, and mechanical components for supporting or attaching the luminaire. Luminaires are sometimes referred to as "lighting fixtures" or as "light fixtures." A lighting fixture that has a socket for a light source, but no light source installed in the socket, is still considered a luminaire. That is, a lighting system lacking some provision for full operability still fits the definition of a luminaire. Luminaires are used in indoor or outdoor applications.

Figure 1A:
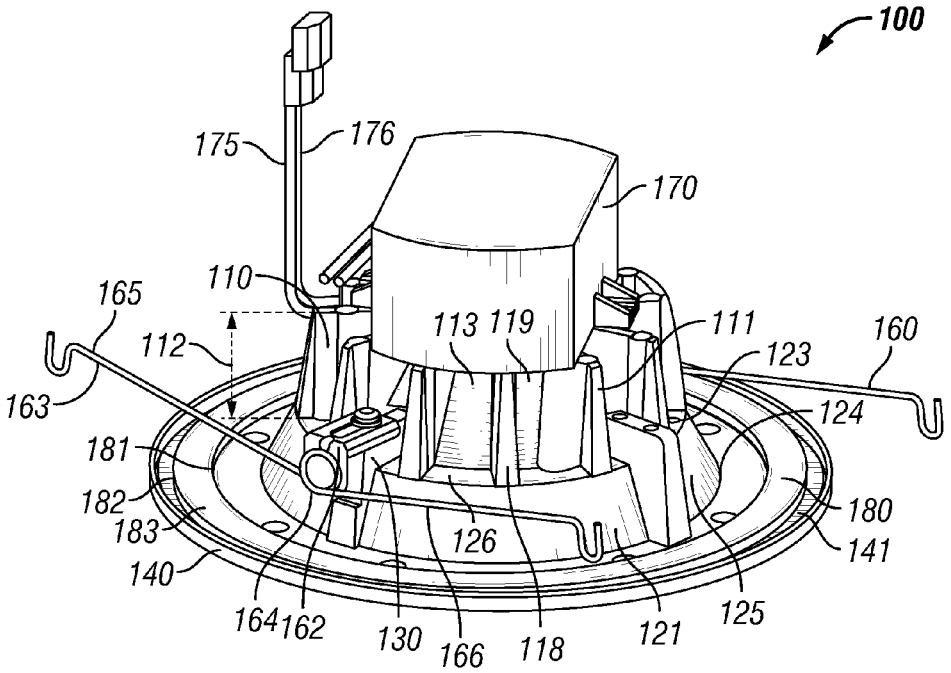
FIG. 1A is a perspective view of an LED module according to an exemplary embodiment of the present invention.
Figure 1B:
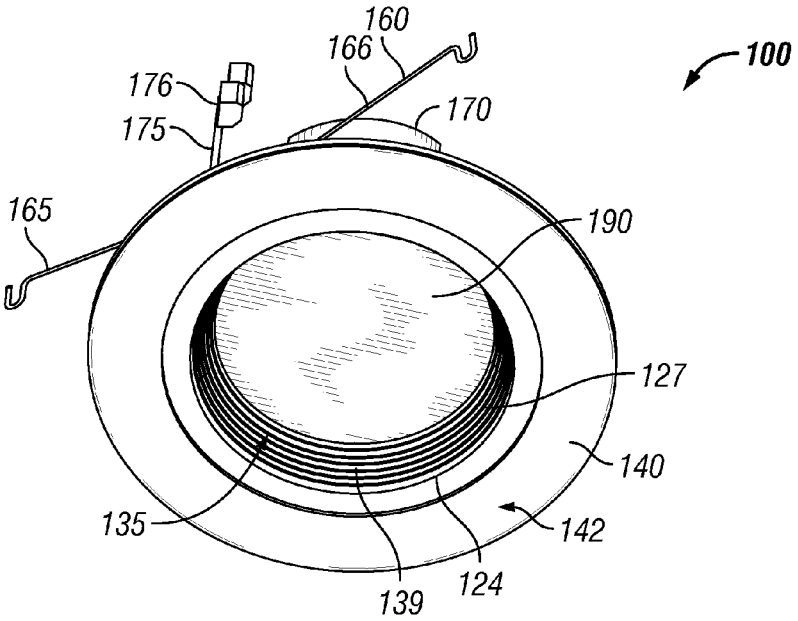
FIG. 1B is another perspective view of the LED module of FIG. 1A according to an exemplary embodiment of the present invention.
Figure 1C:
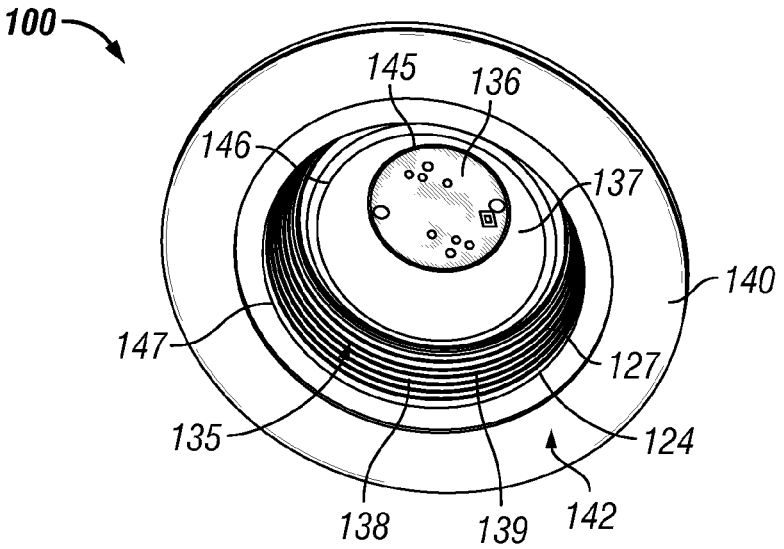
FIG. 1C is another perspective view of the LED module of FIG. 1A having the lens and LED packages removed according to an exemplary embodiment of the present invention.
Figure 2:
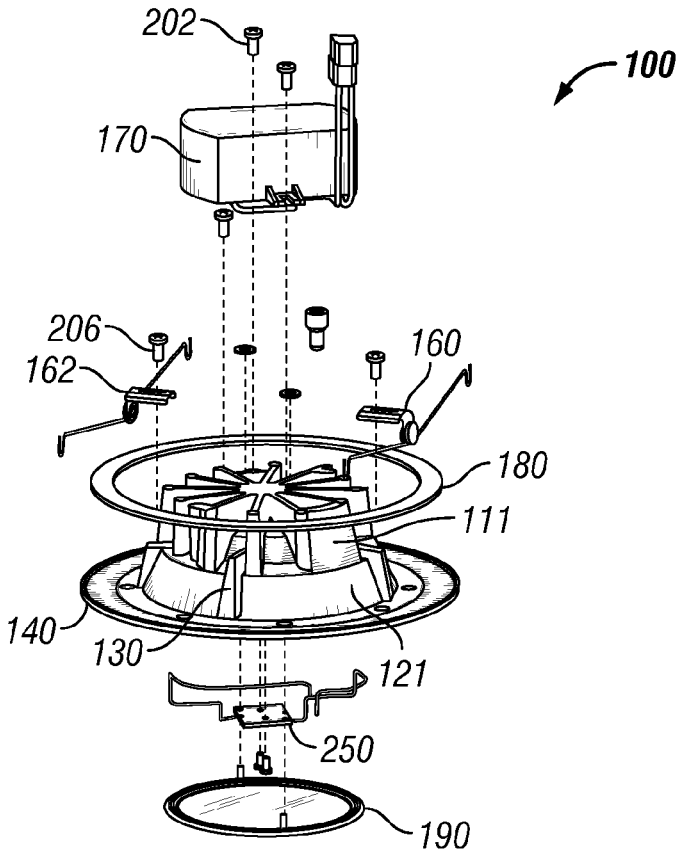
FIG. 2 is an exploded view of the LED module of FIG. 1A according to an exemplary embodiment of the present invention.

The invention may be better understood by reading the following description of non-limiting, exemplary embodiments with reference to the attached drawings, wherein like parts of each of the figures are identified by like reference characters, and which are briefly described as follows. FIGS. 1A, 1B, and 1C are various perspective views of an LED module 100 according to an exemplary embodiment of the present invention. Referring to FIGS. 1A, 1B, and 1C, the LED module 100 includes a heat sink 110, one or more chip on board LEDs 250 (FIG. 2) thermally coupled to the heat sink 110, and one or more torsion spring fastening devices 160 coupled to the heat sink 110 for coupling the LED module 100 to a housing (not shown). According to some exemplary embodiments, one or more discrete LEDs or separate LED dies are used in lieu of, or in combination with, the chip on board LEDs 250 (FIG. 2). In one exemplary embodiment, the housing is a recessed downlight can housing installed within a support structure (not shown), such as a ceiling. The LED module 100 is positionable into a cavity (not shown) formed within the housing. According to some exemplary embodiments, the LED module 100 also includes a driver 170, a gasket 180, and a lens 190 described in further detail below.

The heat sink 110 is formed as a single component and includes a first portion 111, a second portion 121 positioned below the first portion 111, one or more mounting pads 130, a trim ring 140, and a cavity 135 formed therein. The exemplary mounting pads 130 are positioned at different circumferential positions around the second portion 121. The exemplary trim ring 140 extends radially outward from a second end 124 of the second portion 121. The exemplary cavity 135 is surrounded by an internal surface 139 of the heat sink 110.

The first portion 111 extends a first longitudinal length 112 and includes one or more fins 118. The fins 118 extend from an interior portion 113 of the first portion 111 to an outer vertical periphery of the first portion 111. These fins 118 are viewable from the exterior of the heat sink 110 according to certain exemplary embodiments. According to one exemplary embodiment, the fins 118 are integrally formed with the interior portion 113 during casting of the heat sink 110. Alternatively, the fins 118 are coupled to the interior portion 113 of the first portion 111 subsequent to fabrication of the interior portion 113 using welding, fasteners or other methods known to people having ordinary skill in the art. According to one exemplary embodiment, the fins 118 extend substantially the entire first longitudinal length 112. Alternatively, the fins 118 extend a portion of the first longitudinal length 112. In yet another exemplary embodiment, one or more of the fins 118 extend at least a portion of the first longitudinal length 112 and also extend along at least a portion of the outer perimeter of the second portion 121. The fins 118 extend substantially radially around the first portion 111 forming gaps 119 between adjacently positioned fins 118. In other exemplary embodiments, the fins 118 extend substantially parallel to one another, also forming gaps 119 between adjacent fins 118. These fins 118 provide for an increase in exterior surface area of the first portion 111, thereby allowing the first portion 111 to release more of the heat generated by the LED packages 250 (FIG. 2) and/or the driver 170. The first portion 111 is fabricated using a thermally conductive, rigid material, such as a polymer, metal, or metal alloy. One example of the material used to fabricate the first portion 111 is aluminum.

The second portion 121 is positioned generally below the first portion 111 and extends a second longitudinal length 122. The second portion 121 includes a first end 123, a second end 124, and a sidewall 125. In certain exemplary embodiments, the first end 123 has a smaller perimeter than the second end 124. In alternative embodiments, the first end 123 has a perimeter that is equal to or greater than the second end 124. The side wall 125 extends from the first end 123 to the second end 124. The second portion 121 also includes a top surface 126 that is located at the first end 123 and between lower portions of adjacent fins 118. The second end 124 defines an opening 127 that extends within the heat sink 110 to form the cavity 135 therein. According to some exemplary embodiments, the second portion 121 is integrally fabricated with the first portion 111 as a single component. The second portion 121 is fabricated using a thermally conductive, rigid material, such as a polymer, metal, or metal alloy. One example of the material used to fabricate the second portion 121 is aluminum.

In certain exemplary embodiments, the mounting pads 130 are substantially "L" shaped and extend along a portion of the top surface 126 in a raised manner. However, in alternative embodiments the mounting pads 130 are not raised. According to some exemplary embodiments, a portion of each mounting pad 130 also extends along at least a portion of the sidewall 125. In one exemplary embodiment, four mounting pads 130 disposed circumferentially along the second portion 121. However, in other exemplary embodiments, there are fewer or greater numbers of mounting pads 130 disposed circumferentially along the second portion 121. These exemplary mounting pads 130 allow coupling the LED module 100 to the housing using the fastening devices 160, which is described in further detail below with reference to FIGS. 3-5. The mounting pads 130 allow the LED module 100 to be inserted within and coupled to housings having differently sized cavities since the mounting pads 130 include a first locating hole and a second locating hole 452, 453 (FIG. 4) and the fastening devices 160 coupled to the LED module 100 are selectively positionable in either of these locating holes 452, 453 (FIG. 4) depending upon the size of the housing, which is discussed in further detail with respect to FIGS. 3-5. For example, the LED module 100 is capable of being inserted within and coupled to a housing having a five-inch nominal diameter cavity and also to a housing having a six-inch nominal diameter cavity depending upon which of the first or second locating hole 452, 453 (FIG. 4) of the mounting pads 130 is used in conjunction with the fastening devices 160. According to some exemplary embodiments, the mounting pads 130 are integrally fabricated with the first portion 111 and the second portion 121 as a single component and therefore are fabricated using the same material. Alternatively, the mounting pads 130 are fabricated separately from the first portion 111 or the second portion 121 and thereafter coupled to at least one of the first portion 111 and/or the second portion 121 according to other exemplary embodiments. The mounting pads 130 are fabricated using a thermally conductive, rigid material, such as a polymer, metal, or metal alloy. One example of the material used to fabricate the mounting pads 130 is aluminum. Alternatively, the mounting pads 130 are fabricated using any other suitable material, such as any thermally non-conductive material.

As previously mentioned, a portion of the cavity 135 is surrounded by the internal surface 139 which extends within the interior of the heat sink 110. The cavity 135 is formed during the casting process of the heat sink 110 according to certain exemplary embodiments. Alternatively, the cavity 135 is formed by machining into at least a portion of the second end 124 of the heat sink's second portion 121, or by other methods known to people having ordinary skill in the art. The internal surface 139 includes a mounting region 136, a first region 137, and a second region 138. The mounting region 136 is located within the first portion 111 of the heat sink 110 and is substantially planar according to some exemplary embodiments. The mounting region 136 is oriented substantially parallel to the opening 127 and faces the desired illumination area. According to certain exemplary embodiments, the mounting region 136 is circular in shape. Alternatively, the mounting region 136 is shaped into other geometric or non-geometric shapes.

In certain exemplary embodiments, the first region 137 and the second region 138 collectively form a parabolic shape extending from the perimeter of the mounting region 136 to the perimeter of the opening 127. The first region 137 includes a proximal end 145 and a distal end 146, wherein the diameter of the distal end 146 is greater than the diameter of the proximal end 145. However, according to other exemplary embodiments, the diameter of the distal end 146 is smaller than or equal to the diameter of the proximal end 145 in other exemplary embodiments. The proximal end 145 is disposed around the perimeter of the mounting region 136 and the distal end 146 extends outwardly towards the opening 127. The first region 137 is fabricated to be reflective and facilitate directing light emitted from the LED packages 250 (FIG. 2), which are coupled to the mounting region 136, through the opening 127. In some examples, the surface of the first region 137 is entirely smooth. In another example, the surface of the first region 137 includes at least one of a faceted surface, a prismatic surface, and a dimpled surface. The first region 137 is fabricated using the same material used for fabricating the first portion 111, except that the first region 137 is made to be reflective if the first portion 111 is fabricated using non-reflective material. In some examples, the first region 137 is fabricated using a polished metal. In other exemplary embodiments, the first region 137 is fabricated using any suitable reflective material or any material capable of being made reflective, for example, a material capable of having white reflective paint adhered to its surface.

The second region 138 includes the distal end 146 of the first region and a second distal end 147, wherein the diameter of the second distal end 147 is greater than the diameter of the distal end 146. According to other exemplary embodiments, the diameter of the second distal end 147 is smaller than or equal to the diameter of the distal end 146. The second distal end 147 extends to the opening 127 and defines the opening 127. In some examples, the surface of the second region 138 is baffled. In another example, the surface of the second region 138 is smooth. In yet another example, the surface of the second region 138 includes at least one of a faceted surface, a prismatic surface, a dimpled surface, and a painted surface. The second region 138 is fabricated using the same material as that used to fabricate the first region 137, but is finished similarly or differently than the finishing of the first region 137 depending upon design choices.

The trim ring 140 extends radially outward from the second end 124 of the heat sink's second portion 121 and includes a top surface 141 and a bottom surface 142. The trim ring 140 is typically positioned just below the plane of the opening 127. In certain exemplary embodiments, the trim ring 140 is integrally formed with the remaining portions of the heat sink 110. Once the LED module 100 is installed into the housing, the bottom surface 142 of the trim ring 140 is oriented to face the desired illumination area and is observable to one present within the desired illumination area. Also, once the LED module 100 is installed within the housing, the trim ring 140 conceals the space formed around and between the lower exterior portion of the housing and the perimeter of the aperture formed within the support structure. In certain exemplary embodiments, the trim ring 140 is fabricated using a thermally conductive material, such as a polymer, metal, or metal alloy. One example of the material used to fabricate the outer trim ring 140 is aluminum. In the exemplary embodiments where the trim ring 140 is integrally formed with at least the second portion 121, the heat transfer from the second portion 121 to the trim ring 140 is improved because the trim ring 140 is always in constant contact around the entire circumference of the second portion 121. At least a portion of the heat from the heat sink 110 is released into the desired illumination area using the pathway from the second portion 121 of the heat sink 110 to the trim ring 140 and to the desired illumination area.

The heat sink 110 is described as including several components, such as the first portion 111, the second portion 121, one or more mounting pads 130, and the trim ring 140. Each of the components are integrally formed with one another according to several exemplary embodiments; however, some exemplary embodiments have at least one component separately fabricated and thereafter coupled to the remaining portions of the integrally formed heat sink 110. For example, the fins 118 are separately formed and thereafter coupled to the interior portion 113 of the first portion 111 according to some exemplary embodiments. The heat sink 110 is fabricated using a thermally conductive, rigid material, such as a polymer, metal, or metal alloy. One example of the material used to fabricate the heat sink 110 is aluminum. The material used to form some portions of the heat sink 110 is finished differently than another portion of the heat sink 110 according to some exemplary embodiments. For example, at least a portion of the internal surface's first region 137 is polished to be made more reflective according to some exemplary embodiments.

As previously mentioned, the exemplary LED module 100 includes the driver 170. The driver 170 includes circuitry for controlling one or more LED packages 250 (FIG. 2). The driver 170 modifies the power entering the driver 170 through a power supply cable 175 to appropriately control at least a portion of the LED packages 250 (FIG. 2). For example, the driver 170 controls the operation, color, and/or intensity of the light being emitted from the LED packages 250 (FIG. 2). The power supply cable 175 supplies power to the driver 170 from a power source (not shown). According to some embodiments, the power supply cable 175 is fabricated using an insulative cover 176 surrounding one or more thermally conductive wires (not shown). In certain exemplary embodiments, the driver 170 is thermally coupled to a portion of the heat sink 110. According to some exemplary embodiments, the driver 170 is thermally and directly coupled to the top portion of the heat sink's first portion 111 using coupling devices 202 (FIG. 2), such as screws, nails, or rivets. According to another exemplary embodiment, the driver 170 is thermally and indirectly coupled to the top portion of the heat sink's first portion 111 using thermal transference devices (not shown), such as heat pipes. The driver 170 emits heat which is transferred into the heat sink 110. According to some exemplary embodiments, at least a portion of the heat generated from the driver 170 is released into the desired illumination area using the pathway from the driver 170, to the first portion 111 of the heat sink 110, to the second portion 121 of the heat sink 110, to the trim ring 140, and to the desired illumination area.

As previously mentioned, the LED module 100 also includes one or more chip on board LEDs 250 (FIG. 2). The LED packages 250 (FIG. 2) are coupled, either directly or indirectly, to the mounting region 136 of the heat sink 110. According to some exemplary embodiments, the LED packages 250 (FIG. 2) are coupled to a substrate (not shown) which is then coupled to the mounting region 136. The exemplary substrate includes one or more sheets of ceramic, metal, laminate, circuit board, Mylar®, or another material and is coupled to the mounting region 136 of the heat sink 110. Each LED package 250 (FIG. 2) includes a chip of semi-conductive material that is treated to create a positive-negative ("p-n") junction. When the LED or LED package 250 (FIG. 2), such as a chip-on-board LED package, is electrically coupled to a power source, such as the LED driver 170, current flows from the positive side to the negative side of each junction, causing charge carriers to release energy in the form of incoherent light.

The wavelength or color of the emitted light depends on the materials used to make the LED or LED package 250 (FIG. 2). For example, a blue or ultraviolet LED typically includes gallium nitride ("GaN") or indium gallium nitride ("InGaN"), a red LED typically includes aluminum gallium arsenide ("AlGaAs"), and a green LED typically includes aluminum gallium phosphide ("AlGaP"). Each of the LEDs in the LED package 250 (FIG. 2) can produce the same or a distinct color of light. For example, in certain exemplary embodiments, the LED package 250 (FIG. 2) includes one or more white LED's and one or more non-white LEDs, such as red, yellow, amber, or blue LEDs, for adjusting the color temperature output of the light emitted from the LED module 100. A yellow or multi-chromatic phosphor may coat or otherwise be used in a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the LEDs has a color temperature between 2500 and 5000 degrees Kelvin.

In certain exemplary embodiments, an optically transmissive or clear material (not shown) encapsulates at least a portion of each LED or LED package 250 (FIG. 2). This encapsulating material provides environmental protection while transmitting light from the LEDs. In certain exemplary embodiments, the encapsulating material includes a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light. In certain exemplary embodiments, the white light has a color temperature between 2500 and 5000 degrees Kelvin.

In certain exemplary embodiments, the LED is an LED package 250 (FIG. 2) that includes one or more arrays of LEDs that are collectively configured to produce a lumen output from 1 to 5000 lumens. The LEDs or the LED packages 250 (FIG. 2) are attached to the substrate by one or more solder joints, plugs, epoxy or bonding lines, and/or other means for mounting an electrical/optical device on a surface. The substrate is electrically connected to support circuitry (not shown) and/or the LED driver 170 for supplying electrical power and control to the LEDs or LED packages 250 (FIG. 2). For example, one or more wires (not shown) couple opposite ends of the substrate to the LED driver 170, thereby completing a circuit between the LED driver 170, substrate, and LED packages 250 (FIG. 2). In certain exemplary embodiments, the LED driver 170 is configured to separately control one or more portions of the LED packages 250 (FIG. 2) in the array to adjust light color or intensity of the light that is emitted through the opening 127.

The LED packages 250 (FIG. 2) emit heat which is transferred into the heat sink 110. According to some exemplary embodiments, at least a portion of the heat generated from the LED packages 250 (FIG. 2) is released into the desired illumination area using the pathway from the LED packages 250 (FIG. 2), to the mounting region 136 of the heat sink's first portion 111, to the second portion 121 of the heat sink 110, to the trim ring 140, and to the desired illumination area.

As previously mentioned, the exemplary LED module 100 includes the gasket 180. The exemplary gasket 180 is ring-shaped and includes an inner perimeter 181, and outer perimeter 182, an upper surface 183, and a lower surface (not shown). In alternative embodiments, the gasket 180 is shaped in other geometric or non-geometric shapes. The inner perimeter 181 is substantially equal to or larger than the outer perimeter of the second portion's second end 124. The outer perimeter 182 is substantially equal to or smaller than the outer perimeter of the trim ring 140. The gasket 180 is typically disposed on the top surface 141 of the trim ring 140 such that the gasket's lower surface (not shown) is in contact with the trim ring's top surface 141. Once the LED module 100 is inserted into the housing's cavity, at least a portion of the gasket 180, if included within the LED module 100, is disposed between at least a portion of the trim ring's top surface 141 and the surface of the support structure. The exemplary gasket 180 is fabricated using a foam material. However, other suitable materials, such as a rubber and other polymer materials, are suitable for manufacturing the gasket 180 in other exemplary embodiments.

The exemplary LED module 100 also includes the lens 190. The lens 190 is coupled to substantially the distal end 146 of the internal surface's first region 137. According to some exemplary embodiments, the lens 190 is coupled to the distal end 146 using clips (not shown). Alternatively, other devices, such as screws or using the baffles as support, are used to couple the lens 190 in place. Furthermore, in certain alternative embodiments, the lens 190 is positioned either above or below the distal end 146. In certain exemplary embodiments, the lens 190 is fabricated using a transparent or translucent material, such as glass or plastic, which allows light generated from the LED packages 250 (FIG. 2) to pass therethrough. In some exemplary embodiments, the lens 190 is tinted or milky colored to diffuse the light being emitted from the LED packages 250, thereby avoiding an overly bright light source to be seen. The exemplary lens 190 is smooth; however, alternative embodiments utilize a lens 190 that includes micro-patterns, dimples, and/or prismatic elements. The lens 190 provides protection to the LED packages 250 (FIG. 2) from dust and other contaminants. The exemplary lens 190 is substantially concave-shaped having the concaved portion facing the LED packages 250 (FIG. 2). In alternative embodiments, the lens 190 is shaped substantially planar, convexed, or some other shape.

The exemplary LED module 100 also includes fastening devices 160 adjustably coupled to the mounting pads 130. The fastening devices 160, in conjunction with the mounting pads 130, facilitate the adjustable coupling of the LED module 100 into housings having different cavity diameter sizes. Each fastening device 160 includes a mounting bracket 162 and a torsion spring 163 coupled to the mounting bracket 162. Torsion springs 163 are known to people having ordinary skill in the art and are used for coupling the LED module 100 to an interior wall surrounding the cavity formed within the housing (not shown). The torsion spring 163 includes a ring portion 164, a first rod 165 extending from the ring portion 164 in a first direction, and a second rod 166 extending from the ring portion 164 in a second direction. As the first rod 165 is moved closer to the second rod 166, the first and second rods 165, 166 produce a biasing effect which, once coupled within a torsion spring receiver (not shown) in the housing, facilitates coupling of the LED module 100 into the housing's cavity, which is known to people having ordinary skill in the art. The fastening device 160 is coupled to the mounting pad 130 using a coupling device 206 (FIG. 2), such as a screw, being inserted through a portion of the mounting bracket 162 and into the mounting pad 130. The fastening device 160 and the adjustable coupling of the fastening device 160 to the mounting pads 130 are described in further detail below in conjunction with FIGS. 3-5.

Figure 6:
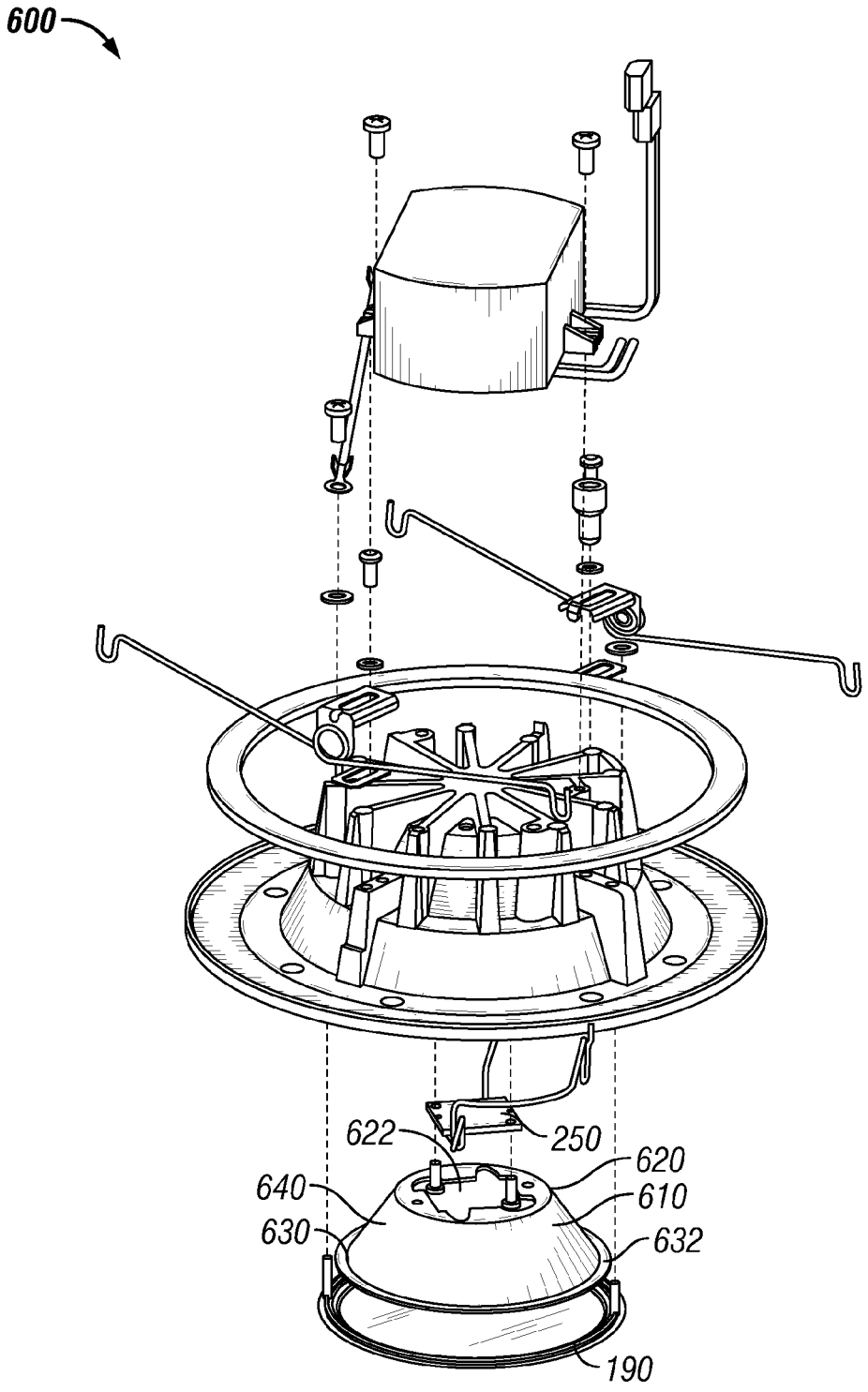
FIG. 6 is an exploded view of an LED module according to another exemplary embodiment of the present invention.

FIG. 2 is an exploded view of the LED module 100 according to an exemplary embodiment of the present invention. Referring to FIGS. 1A, 1B, 1C, and 2, the heat sink 110 is formed as a single integral component and includes the first portion 111, the second portion 121, the mounting pads 130, and the trim ring 140. The LED package 250 is inserted into the cavity 135 formed within the heat sink 110 and is coupled to the mounting region 136. The lens 190 also is inserted into the cavity 135 and is coupled to the internal surface 139 at about the distal end 146, located between the first region 137 and the second region 138. The gasket 180 is disposed on the trim ring 140 according to the description provided above. The fastening devices 160 are coupled to the mounting pads 130 using coupling devices 206, such as screws, according to the description provided above and further descriptions to be provided below. The driver 170 is coupled to the top end of the heat sink's first portion 111 using coupling devices 202 according to the description provided above. Although FIG. 2 illustrates several components being coupled together to form the LED module 100, the LED module 100 is formed using fewer components and/or additional components, such as a modular reflector 610 (FIG. 6), according to other exemplary embodiments.

Figure 3:
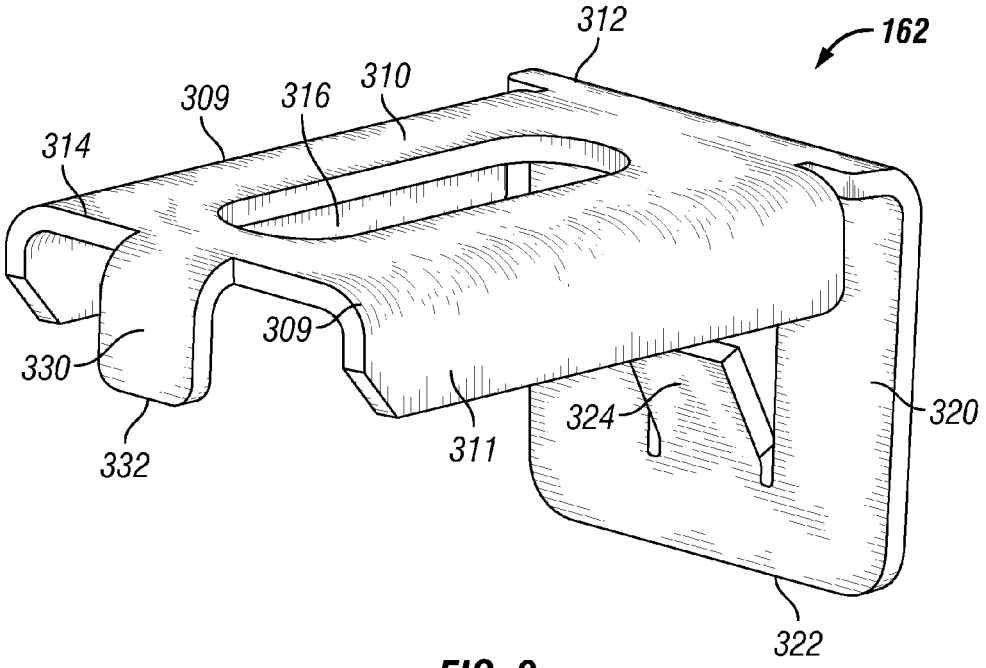
FIG. 3 is a perspective view of the mounting bracket capable of being used in the LED module of FIG. 2 according to an exemplary embodiment of the present invention.
Figure 4:
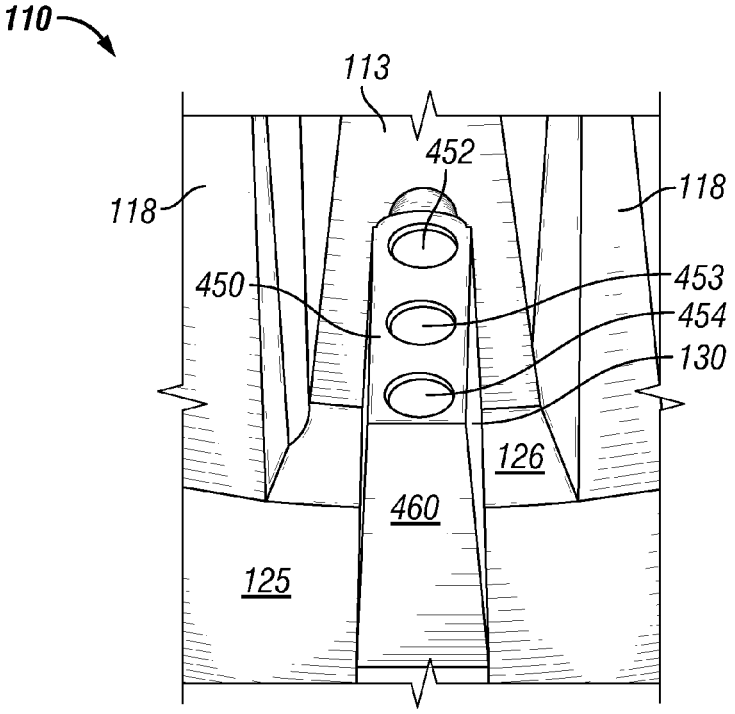
FIG. 4 is a partial perspective view of the heat sink capable of being used in the LED module of FIG. 2 illustrating the mounting pad according to an exemplary embodiment of the present invention.
Figure 5:
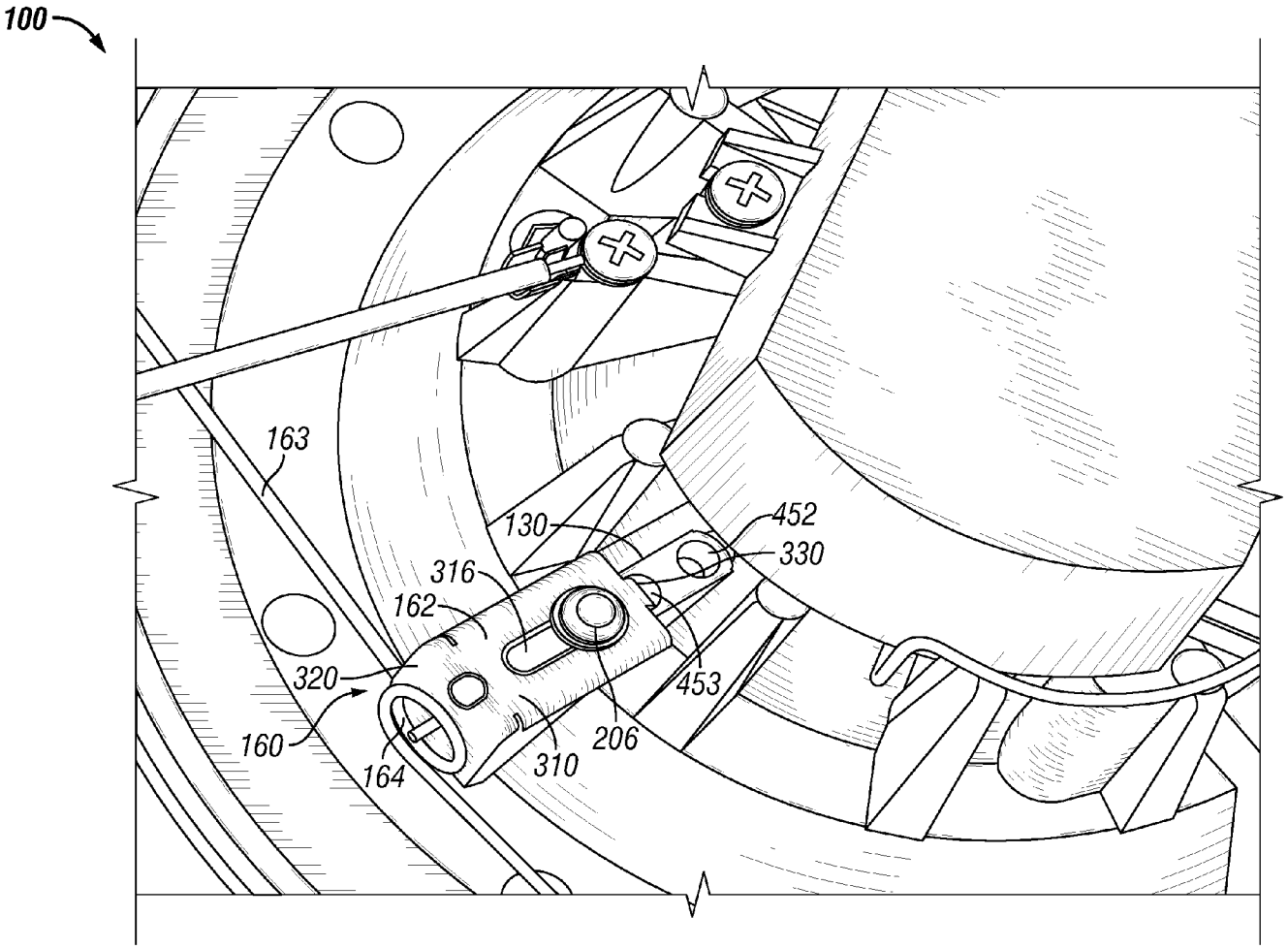
FIG. 5 is a partial perspective view of the LED module of FIG. 1A illustrating the mounting bracket of FIG. 3 coupled to the mounting pad of FIG. 4 according to an exemplary embodiment of the present invention.

FIG. 3 is a perspective view of the mounting bracket 162 according to an exemplary embodiment of the present invention. FIG. 4 is a partial perspective view of the heat sink 110 illustrating the mounting pad 130 according to an exemplary embodiment of the present invention. FIG. 5 is a partial perspective view of the LED module 100 illustrating the mounting bracket 162 coupled to the mounting pad 130 according to an exemplary embodiment of the present invention. Referring to FIGS. 3-5, the mounting bracket 162 is adjustably coupled to the mounting pad 130 and the torsion spring 163 is coupled to a portion of the mounting bracket 162.

Referring to FIG. 3, the mounting bracket 162 includes a first portion 310, a second portion 320, and a tab 330. In one exemplary embodiment, the second portion 320 and the tab 330 each extend substantially perpendicular to the first portion 310. The first portion 310 and second portion 320 are substantially planar. Alternatively, one or both of the first 310 and second 320 portions is non-planar. The exemplary first portion 310 extends longitudinally from a first end 312 to a second end 314. The first portion 310 includes a slot 316 that extends longitudinally along the first portion 310 and is positioned between the first end 312 and the second end 314. The exemplary slot 316 extends through the first portion 310 and is formed during the casting process of the mounting bracket 162. The first portion 310 also includes a lateral edge 311 extending downwardly from each of the longitudinal edges 309 of first portion's planar portion. The inner distance between each of the lateral edges 311 is slightly bigger than the width of the mounting pad 130 (FIG. 4) to prevent the mounting bracket 162 from rotating or moving from side-to-side once couple to the respective mounting pad 130 (FIG. 4).

The second portion 320 extends longitudinally from the first end 312 to an opposing end 322. The second portion 320 includes a torsion spring bracket 324, which facilitates coupling the torsion spring 163 to the second portion 320. The torsion spring bracket 324 is formed by cutting through an interior portion of the second portion 320 and pushing a portion of the second portion 320, which forms the torsion spring bracket 324, into a different plane that is at an angle with the plane that the rest of the second portion 320 resides. The plane in which the torsion spring bracket 324 resides intersects with the first portion 310 according to some exemplary embodiments.

The exemplary tab 330 is substantially planar and extends longitudinally from a portion of the second end 314 to a distal end 332. In certain exemplary embodiments, the tab 330 extends substantially from the middle of the second end 314. The tab 330 extends in a plane that is substantially parallel to the plane of the second portion 320. The exemplary mounting bracket 162 is fabricated as a single component, but can alternatively be fabricated in several components and thereafter assembled together. The mounting bracket 162 is fabricated using a polymer material, metal, metal alloy, or other suitable materials known to people having ordinary skill in the art.

Referring to FIG. 4, the mounting pad 130 includes a first portion 450 and a second portion 460 and, in certain exemplary embodiments, is positioned between two adjacent fins 118. The first portion 450 extends substantially along a portion of the top surface 126 in a raised and radial manner, while the second portion 460 is substantially perpendicular to the first portion 450 and extends from one end of the first portion 450 along at least a portion of the sidewall 125. The first portion 450 includes a first locating hole 452 and a second locating hole 453, each dimensioned for receiving the tab 330 (FIG. 3), and a coupling hole 454 that is dimensioned for receiving the coupling device 206 (FIG. 2). In one exemplary embodiment, each locating hole 452, 453 and the coupling hole 454 are linearly aligned, but can be non-linearly aligned in other exemplary embodiments. According to some exemplary embodiments, the first locating hole 452 is positioned closest to the interior portion 113, the coupling hole 454 is positioned furthest from the interior portion 113, and the second locating hole 453 is positioned between the first locating hole 452 and the coupling hole 454. The locating holes 452, 453 and the coupling hole 454 are formed by machining through at least a portion of the mounting pad's first portion 450. The exemplary locating holes 452, 453 and coupling hole 454 are circular. Alternatively, the locating holes 452, 453 and/or the coupling hole 454 are shaped in other geometric or non-geometric shapes. According to one exemplary embodiment, the centerpoint of each adjacent locating hole 452, 453 are distanced one inch apart. However, the distance is variable in other exemplary embodiments.

Referring to FIGS. 3-5, the fastening device 160 is assembled and coupled to the mounting pad 130. The fastening device 160 is assembled by snapping the torsion spring 163 onto the torsion spring bracket 324. Specifically, the ring portion 164 is slid from the opposing end 322 of the mounting bracket's second portion 320 until the ring portion 164 snaps onto the torsion spring bracket 324. However, other methods known to people having ordinary skill in the art can be used to coupled the torsion spring 163 to the mounting bracket 162.

The fastening device 160 is coupled to the mounting pad 130 by positioning the mounting bracket's first portion 310 above and substantially parallel to the mounting pad's first portion 450 and the mounting bracket's second portion 320 adjacent and substantially parallel to the mounting pad's second portion 460. According to one exemplary embodiment, the tab 330 is inserted into the second locating hole 453 and the coupling device 206 is inserted through the slot 316 and into the coupling hole 454. Thus a portion of the coupling device 206 rests above the mounting bracket's first portion 310, while a portion of the coupling device 206 is inserted and coupled within the coupling hole 454. When the tab 330 is inserted into the second locating hole 453, the LED module 100 fits within a housing having a certain nominal diameter cavity. However, if the LED module 100 is to be fitted within a housing having a smaller nominal diameter cavity, the coupling device 206 is loosened so that the tab 330 is removed from the second locating hole 453 and moved into the first locating hole 452. When moving the tab 330 from the second locating hole 453 to the first locating hole 452, the mounting bracket 162 is moved closer to the interior portion 113 by sliding the coupling device 206 along the length of the slot 316. Once the tab 330 is inserted into the first locating hole 452, the coupling device 206 is securely re-coupled into the coupling hole 454. Alternatively, instead of loosening the coupling device 206, the coupling device 206 is removed when adjusting the position of the mounting bracket 162. Thus, the LED module 100 is capable of being installed within different housings having different nominal diameter cavities.

Although one example has been provided for achieving this flexibility, this flexibility is achievable in different manners, all of which are encompassed within the several exemplary embodiments. For instance, instead of a slot 316 formed into the first portion 310 of the mounting bracket 162, two or more openings (not shown) are formed into the first portion 310 of the mounting bracket 162 in other exemplary embodiments. Each of these openings are capable of receiving the coupling device 206 therethrough. In another example, instead of locating holes 452, 453 formed into the mounting pad's first portion 450, bosses (not shown) are formed in the same locations as the locating holes 452, 453 and openings (not shown) are formed into the first portion 310 of the mounting bracket 162 such that at least one opening fits onto and surrounds one of the bosses. The bosses are formed to extend above the top surface of the mounting pad's first portion 450. In yet another example, instead of a slot 316 formed into the first portion 310 of the mounting bracket 162, at least one opening (not shown) is formed into the first portion 310 of the mounting bracket 162 and a portion of the heat sink 110 includes one or more receiving holes (not shown) such that the coupling device 206 couples the mounting bracket 162 to the heat sink 110 by being inserted into the receiving hole through the opening on the mounting bracket 162.

FIG. 4 is an exploded view of an LED module 600 according to another exemplary embodiment of the present invention. LED module 600 is similar to LED module 100 (FIG. 2) except that LED module 600 includes the modular reflector 610. The modular reflector 610 is parabolic-shaped and has a proximal end 620, a distal end 630, and a sidewall 640 extending from the perimeter of the proximal end 620 to the perimeter of the distal end 630. The proximal end 620 has a smaller perimeter than the distal end 630 according to some exemplary embodiments; however, the proximal end 620 has a perimeter that is not smaller than the distal end 630 in other exemplary embodiments. The proximal end 620 includes a proximal opening 622 that is dimensioned so that the proximal end 620 is installed within the cavity 135 (FIG. 1C) and is disposed around the LED package 250 once installed therein. In one exemplary embodiment, the distal end 630 forms a flange 632 that bends outwardly from the reflector 610. In certain exemplary embodiments, the creation of the flange 632 facilitates the coupling of the lens 190 to the distal end 630 of the reflector 610. The exemplary parabolic-shaped reflector 610 focuses the light emitted by the LED packages 250 to create a beam of light that is emitted to the desired illumination area. The sidewall 640 of the reflector 610 includes an internal surface (not shown), which is reflective and smooth. Alternatively, the internal surface includes at least one of facets, prismatic elements, and/or dimples around the internal surface. The reflector 610 is fabricated using a reflective material or fabricated using a non-reflective material and subsequently made to be reflective by painting the internal surface with white reflective paint or other known methods.

Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A light module, comprising:

one or more light sources coupled to a heat sink;

a plurality of mounting pads disposed circumferentially around an external surface of the heat sink for separably coupling the light module to a housing cavity having a first diameter or a housing cavity having a second diameter, wherein each mounting pad comprises:

a first portion that radially extends from the heat sink, a second portion that is substantially perpendicular to the first portion, and at least one receiving hole located on the first portion of the respective mounting pad; and a plurality of mounting brackets, each mounting bracket removably coupled to the respective mounting pad and comprising:

a first planar portion comprising a first end, a second end, a pair of longitudinal edges extending from the first end to the second end, and a slot formed between the pair of longitudinal edges and extending along a portion of the first planar portion;

a second planar portion extending substantially perpendicularly and downwardly from one of the first end and the second end and comprising a mechanism for mounting a torsion spring, wherein at least a portion of the slot is aligned with the at least one receiving hole, the at least one receiving hole and the slot adapted to receive a coupling device to couple the mounting bracket to the mounting pad, wherein the light module is coupled to the housing cavity having the first diameter when the mounting bracket is fastened to the mounting pad at a first position of the slot, and wherein the light module is coupled to the housing cavity having the second diameter when the mounting bracket is fastened to the mounting pad at a second position of the slot.

2. The light module of claim 1, wherein the heat sink comprises an internal surface comprising:

a mounting region;

a reflector region extending from a perimeter of the mounting region to a distal end; and a decorative region extending from the distal end to a second distal end;

wherein the one or more light sources are coupled to the mounting region within the heat sink cavity.

3. The light module of claim 1, further comprising: a trim ring extending radially outward from substantially an end portion of the heat sink, wherein the trim ring and the heat sink are integrally formed as a single component thereby providing continuous non-movable contact between the trim ring and the heat sink.

4. The light module of claim 1, wherein the at least one receiving hole is a recessed opening formed within the mounting pad.

5. The light module of claim 3, further comprising: a ring-shaped gasket that is disposed on a top surface of the trim ring such that the ring-shaped gasket is sandwiched between a portion of a support structure and the top surface of the trim ring when the light module is installed.

6. A light module, comprising:

one or more light sources coupled to a heat sink;

a plurality of mounting pads disposed circumferentially around an external surface of the heat sink for separably coupling the light module to a housing having a five inch diameter cavity or a housing having a six inch diameter cavity, wherein each mounting pad comprises:

a first portion that radially extends from the heat sink, a second portion that is substantially perpendicular to the first portion, and at least one receiving hole and at least one boss located on the first portion of the respective mounting pad; and a plurality of mounting brackets, each mounting bracket removably coupled to one of the respective mounting pads and comprising:

a first planar portion comprising:

a first end, a second end opposite to the first end, a pair of longitudinal edges extending from the first end to the second end, a slot formed between the pair of longitudinal edges and extending along a portion of the first planar portion, and an opening formed between the pair of longitudinal edges and adjacent the slot, and a second planar portion extending substantially perpendicularly and downwardly from one of the first end and the second end, wherein at least a portion of the slot of the mounting bracket is aligned with the at least one receiving hole of the mounting pad and receives a coupling device therethrough, and wherein the opening of the mounting bracket engages with the at least one boss of the mounting pad.

7. The light module of claim 6, wherein the heat sink comprises an internal surface comprising:

a mounting region;

a reflector region extending from the perimeter of the mounting region to a distal end; and a decorative region extending from the distal end to a second distal end;

wherein the one or more light sources are coupled to the mounting region within the heat sink cavity.

8. The light module of claim 6, further comprising: a trim ring extending radially outward from substantially an end portion of the heat sink, wherein the trim ring and the heat sink are integrally formed as a single component thereby providing continuous non-movable contact between the trim ring and the heat sink.

9. The light module of claim 6, wherein the at least one receiving hole is a recessed opening formed within the mounting pad.

10. The light module of claim 8, further comprising: a ring-shaped gasket that is disposed on a top surface of the trim ring such that the ring-shaped gasket is sandwiched between a portion of a support structure and the top surface of the trim ring when the light module is installed.

11. A light module, comprising:

one or more light sources coupled to a heat sink;

a plurality of mounting pads disposed circumferentially around an external surface of the heat sink for separably coupling the light module to a housing cavity having a first diameter or a housing cavity having a second diameter, wherein each mounting pad comprises:

a portion that radially extends from the heat sink, and at least one receiving hole located on the portion of the respective mounting pad that radially extends from the heat sink; and a plurality of mounting brackets, each mounting bracket removably coupled to the respective mounting pad and comprising:

a first planar portion comprising a first end, a second end, a pair of longitudinal edges extending from the first end to the second end, and a slot formed between the pair of longitudinal edges and extending along a portion of the first planar portion;

a second planar portion extending substantially perpendicularly and downwardly from one of the first end and the second end and comprising a mechanism for mounting a torsion spring, wherein at least a portion of the slot is aligned with the at least one receiving hole, the at least one receiving hole and the slot adapted to receive a coupling device to couple the mounting bracket to the mounting pad, wherein the light module is coupled to the housing cavity having the first diameter when the mounting bracket is fastened to the mounting pad at a first position of the slot, and wherein the light module is coupled to the housing cavity having the second diameter when the mounting bracket is fastened to the mounting pad at a second position of the slot.

12. The light module of claim 11, wherein the heat sink comprises an internal surface comprising:

a mounting region;

a reflector region extending from a perimeter of the mounting region to a distal end; and a decorative region extending from the distal end to a second distal end;

wherein the one or more light sources are coupled to the mounting region within the heat sink cavity.

13. The light module of claim 11, further comprising: a trim ring extending radially outward from substantially an end portion of the heat sink, wherein the trim ring and the heat sink are integrally formed as a single component thereby providing continuous non-movable contact between the trim ring and the heat sink.

14. The light module of claim 13, further comprising: a ring-shaped gasket that is disposed on a top surface of the trim ring such that the ring-shaped gasket is sandwiched between a portion of a support structure and the top surface of the trim ring when the light module is installed.

* * * * *